US010464716B1

(12) United States Patent
Ham et al.

(10) Patent No.: US 10,464,716 B1
(45) Date of Patent: Nov. 5, 2019

(54) CONTAINER HAVING AN ADHESIVELY ATTACHED FITMENT

(71) Applicant: The Procter & Gamble Company, Cincinnati, OH (US)

(72) Inventors: Kyle Frederic Ham, Cincinnati, OH (US); Emil Paul Bader, Cincinnati, OH (US); Andrew Eric Neltner, Loveland, OH (US); Timothy Sean Peppard, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 15/986,447

(22) Filed: May 22, 2018

(51) Int. Cl.
*B65D 25/42* (2006.01)
*B65D 47/12* (2006.01)
*B65D 43/16* (2006.01)

(52) U.S. Cl.
CPC ..... *B65D 25/42* (2013.01); *B65D 43/162* (2013.01); *B65D 47/122* (2013.01)

(58) Field of Classification Search
CPC ..... B65D 25/42; B65D 43/162; B65D 47/122
See application file for complete search history.

(56) References Cited

U.S. PATENT DOCUMENTS 3,926,348 A * 12/1975 Lutzker ..... B65D 41/28 222/189.07
4,533,058 A 8/1985 Uhlig
5,174,460 A 12/1992 Minnette
5,941,422 A * 8/1999 Struble ..... B29C 65/0672 222/109
6,213,993 B1 * 4/2001 Zacharias ..... A61F 13/5611 604/386
6,279,789 B1 * 8/2001 Krall ..... B65D 41/20 220/254.1
6,964,359 B1 * 11/2005 Darr ..... B65D 47/06 222/570
7,014,078 B2 * 3/2006 Walsh ..... B44D 3/12 222/109
7,442,739 B1 * 10/2008 Hatfield ..... C09J 153/02 524/474
2005/0087548 A1 4/2005 Smith
2007/0194047 A1 * 8/2007 Tauber ..... B65D 47/122 222/109
2007/0295767 A1 * 12/2007 Angelo ..... B65D 41/26 222/564
2008/0230572 A1 * 9/2008 Angelo ..... B65D 25/48 222/566

(Continued)

FOREIGN PATENT DOCUMENTS

WO WO9816623 A1 4/1998

OTHER PUBLICATIONS

International Search Report for International Application Serial No. PCT/US2019/032408, dated Aug. 12, 2019, 14 Pages.

*Primary Examiner* — Frederick C Nicolas
(74) *Attorney, Agent, or Firm* — Gary J. Foose

(57) ABSTRACT

A container including a container body having a neck finish having a longitudinal axis. A fitment is fitted at least partially within the neck finish. The fitment has a slot extending at least partially around the longitudinal axis. An adhesive is positioned within the slot between said neck finish and said fitment. The adhesive has a Tan Delta from about 0.65 to about 3.

19 Claims, 11 Drawing Sheets

(56) References Cited

U.S. PATENT DOCUMENTS

| | | | | |
|---|---|---|---|---|
| 2013/0327795 | A1* | 12/2013 | Krammer | B65D 1/023<br>222/568 |
| 2015/0041423 | A1* | 2/2015 | Schmertz, Jr. | B65D 47/00<br>215/43 |
| 2017/0174380 | A1* | 6/2017 | Blackwell | C09J 7/20 |

* cited by examiner

CONTAINER HAVING AN ADHESIVELY ATTACHED FITMENT

FIELD OF THE INVENTION

Background of the Invention

Consumers are increasingly demanding to have consumer products shipped directly to their household. This is particularly true for heavy liquid consumer products such as liquid laundry detergent, liquid fabric softener, hand and body soap, cooking oil, olive oil, and the like. Shipping liquid products directly to the consumer is a challenging task due to the rough handling that might occur to the product during transfer of the liquid product from the manufacturer to the consumer. Rough handling can impart stresses on the container that are much greater than might occur in traditional retail shipping channels from the manufacturer to the retailer.

Manufacturers of liquid consumer products prefer to use the same container designs in both retail trade channels and direct to consumer channels. This simplifies production and management of inventory for the manufacturer. For many liquid consumer products, the preferred container is an extrusion blow molded container body and a fitment. The fitment may be a closure, such as a flip top closure, or a spout having a drain-back feature with the fitment configured to receive a closure.

Blow molded container bodies to which a fitment is attached are subject to leaking between the container body and the fitment during direct shipping to the consumer. A costly answer to this problem would be to employ a blow molded container body having calibrated neck and a plug seal fitment. Such a container body may be over-designed for the retail channel of trade, and thus be overly expensive. Providing additional cushioning and or placing the container in a sealed bag within the box and or shrink sleeving the entire container are other approaches for solving the problem, all which add additional cost to the manufacturer.

With these limitations in mind, there is a continuing unaddressed need for a container for liquid products that has a fitment attached thereto that is resistant to leakage during transport in different channels of trade.

SUMMARY OF THE INVENTION

A container (10) comprising: a container body (20) having a closed end (30) and an opposing open end (40), wherein said open end comprises a neck finish (50) having a longitudinal axis (L) passing through said open end, an inner surface (60) oriented towards said longitudinal axis, an outer surface (70) oriented away from said longitudinal axis, and a top surface (80) extending between said inner surface and said outer surface; a fitment (90) fitted at least partially within said neck finish, said fitment comprising an external flange (100) exterior to said neck finish and downwardly depending towards said closed end, an internal flange (110) interior to said neck finish and downwardly depending towards said closed end, and a bridge (120) extending across said top surface from said external flange to said internal flange, wherein said external flange, said bridge, and said internal flange together form a slot (130) extending at least partially around said longitudinal axis; and an adhesive (140) positioned within said slot between said neck finish and said fitment, wherein said adhesive has a Tan Delta from about 0.65 to about 3.

DETAILED DESCRIPTION OF THE INVENTION

Figure 1:
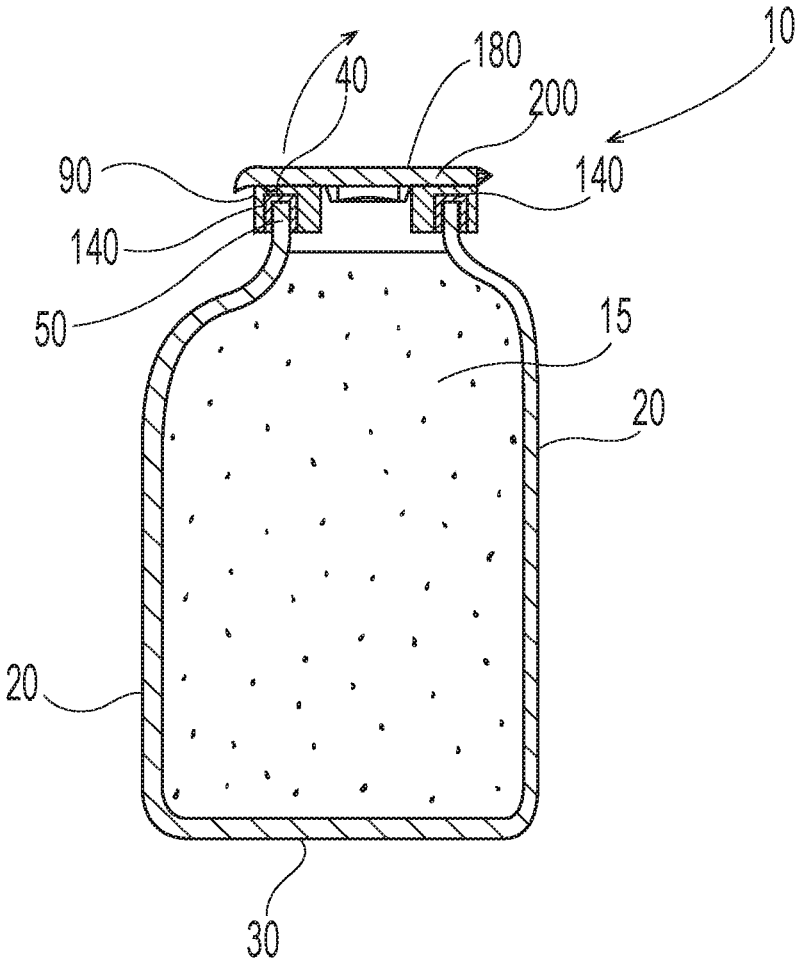
FIG. 1 is a container.

A container 10 is shown in FIG. 1. The container 10 can be suitable for containing a liquid consumer product 15. The liquid consumer product 15 can be selected from the group consisting of liquid laundry detergent, liquid fabric softener, liquid hand soap, liquid body soap, liquid cooking oil, olive oil, liquid skin lotion, liquid hand dish detergent, liquid automatic dish detergent, and liquid surface cleaner. A fitment 90 can be fitted to the container 10. The fitment 10 can be a closure 180 or part of a closure system that includes a spout. The fitment can be a flip top closure 200. The container body 20 can contain from about 1 to about 5 L of a liquid fabric treatment composition having a density of from about 0.7 to about 1.2 g/cm$^3$, optionally from about 0.8 to about 1 g/cm$^3$. The liquid fabric treatment composition can be a liquid laundry detergent or a liquid fabric enhancer. The container 10 described herein can be particularly practical for a container body 20 sized and dimensioned to contain about 1 L to about 5 L or a liquid fabric treatment composition having a density from about 0.7 to about 1.2 g/cm$^3$ since such containers 10 end up having a large amount of momentum when they impact a stationary object, as might happen when such a container 10 is dropped during shipment. The high quantity of momentum can result in appreciable stresses on the adhesive 140 that seals the fitment 90 to the neck finish 50 and the adhesives 140 described herein can help to dissipate the force of impact over a longer time, thereby lowering the maximum stress level on the fitment, closure 180 if present, container 20, and adhesive 140.

The container body 20 can be a thermoplastic container body 20. Thermoplastic container bodies 20 can be formed by extrusion blow molding, injection blow molding, compression blow forming, and injection stretch blow molding. Similarly, the fitment 90 can be a thermoplastic fitment 90. A thermoplastic fitment 90 can be formed by injection molding.

The fitment 90 can attached to the container body 20. The fitment 90 can be attached to the neck finish 50 at the open end 40 of the container body 20 by a snap fit connection between the fitment 90 and the container body 20. An adhesive 140 can be provided to affix the fitment 90 to the neck finish 50 of the container body 20.

Figure 2:
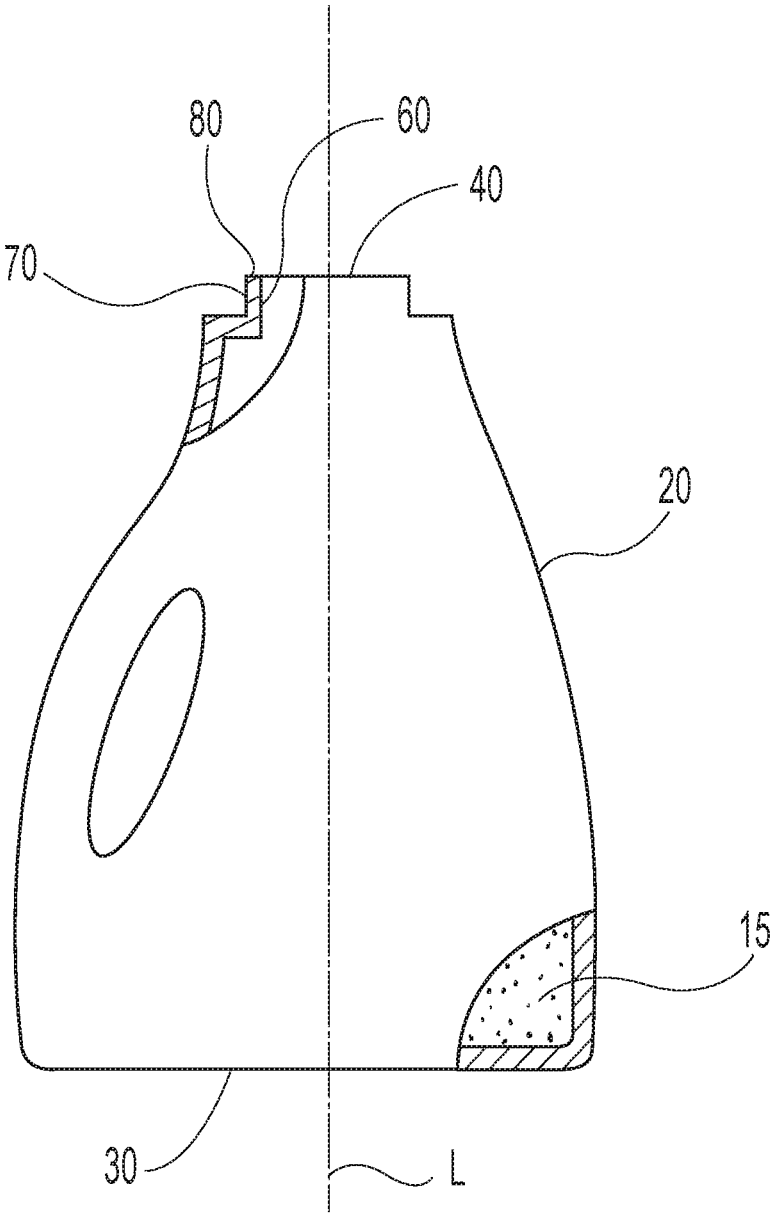
FIG. 2 is a container body.

A container 10 is shown in greater detail in FIG. 2. The container body 20 can have a closed end 30 and an opposing open end 40. In use, the container 10 is typically stored by resting the closed end 30 of the container 10 on a flat surface. The open end 40 can comprise a neck finish 50. The neck finish 50 is the structure proximal the top of the container body 20 that is designed such that a fitment 90 can be attached thereto. The neck finish 50 and the fitment 90 are designed to fit with one another.

The neck finish 50 can have a longitudinal axis L passing through the open end 40. FIG. 2 is a partial sectional view in which part of the container body 20 proximal the open end 40 is removed. The open end 40 can have an inner surface 60 oriented towards the longitudinal axis L. Further, the open end 40 can have an outer surface 70 oriented away from the longitudinal axis L. Further, the open end 40 can have a top surface 80 extending between the inner surface 60 and outer surface 70.

Figure 3:
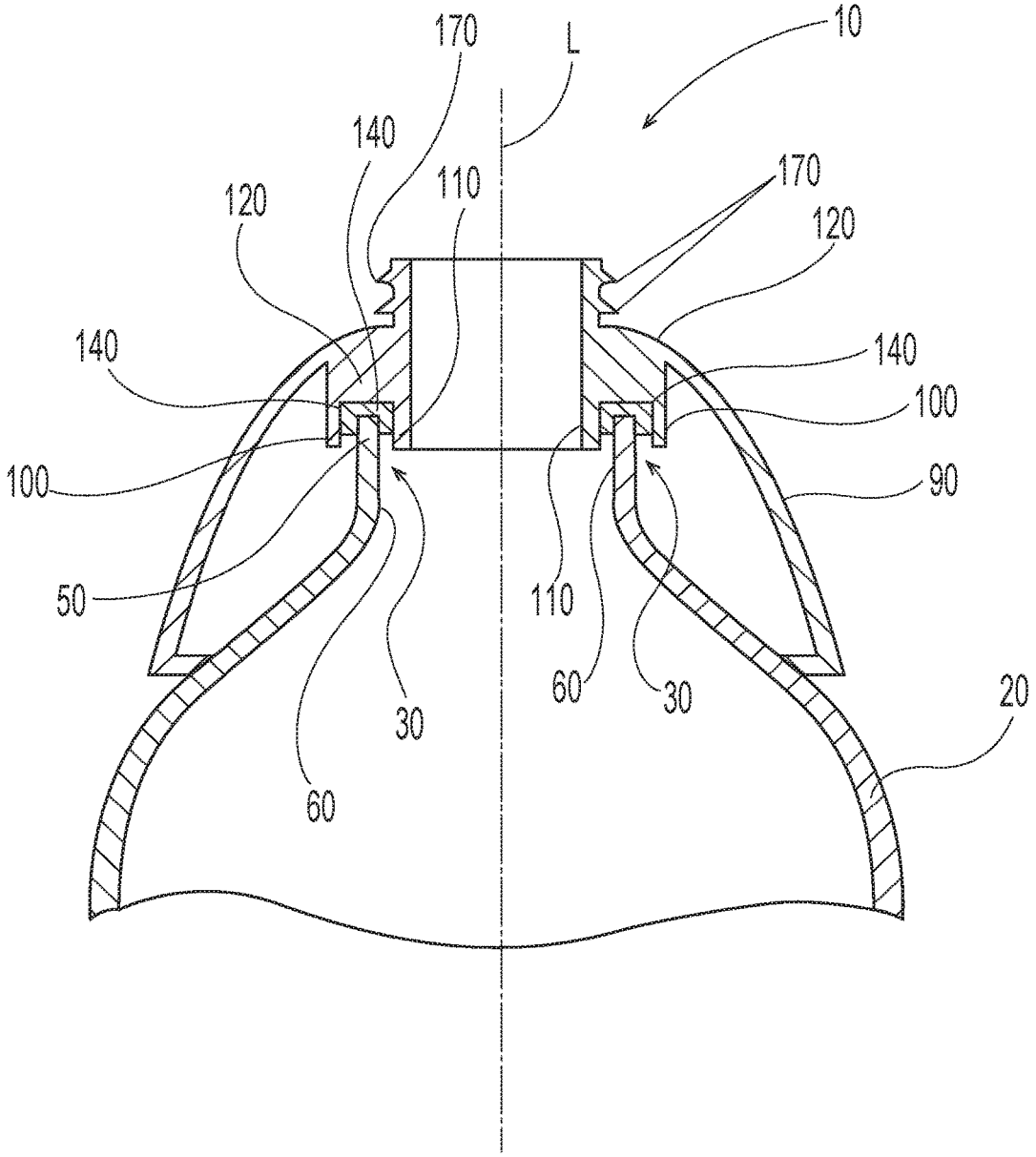
FIG. 3 is a fitment attached to a neck finish, part of the container body being shown.

Part of a fitment 90 attached to a neck finish 50 is shown in FIG. 3. The fitment 90 can be at least partially within the neck finish 50. By partially within it is meant that a portion of the fitment 90 is positioned below the top surface 80. That is, a portion of the fitment 90 is positioned between the top surface 80 and the closed end 30. A portion of a fitment 90 that is a closure 180 or a fitment 90 that comprises a spout can be fit down into the open end 40 of the container body 20.

The fitment 90 can comprise an external flange 100 exterior to the neck finish 50. That is the external flange 100 can be positioned so the that the neck finish 50 is between external flange 100 and the longitudinal axis L. The external flange 100 is the part of the fitment 90 that can be in contact with or attached to the outer surface 70 of the neck finish 50. The external flange 100 can circumscribe or partially circumscribe the exterior of the neck finish 50. The external flange 100 can be downwardly depending towards the closed end 30.

The fitment 90 can further comprise an internal flange 110 that is interior to the neck finish 50 and downwardly depending towards the closed end 30. Together, the external flange 100 and the internal flange 11 can fit over the neck finish 50. The external flange 100 and internal flange 110 are complementary to one another to fit over the neck finish. The external flange 100 and internal flange 110 can fit tightly against the neck finish 50. The internal flange 110 is part of the fitment 90 that can be in contact with or attached to the inner surface 60 of the neck finish 50. The neck finish 50 can circumscribe or partially circumscribe the internal flange 110.

The fitment 90 can further comprise a bridge 120 extending across the top surface 80. The bridge 120 can be positioned so that the top surface 80 is between the bridge 120 and the closed end 30. The bridge 120 can extend across the top surface 80 from the external flange 100 to the internal flange 110. The external flange 100, bridge 120, and internal flange 110 can together form a slot 130 that extends at least partially around or even fully around the longitudinal axis L. The neck finish 50 can fit into the slot 130. The fit may be a tight fit such that a considerable amount of force is required to engage the fitment 90 with the neck finish 50.

An adhesive 140 can be positioned within the slot 130 between the neck finish 50 and the fitment 90. The adhesive 140 can positioned so that it is entirely on the top surface 80 of the neck finish 50. Optionally, the adhesive 140 can be positioned so that it is between the external flange 100 and the outer surface 70 of the neck finish 50. The adhesive 140 can be positioned so that it is between the internal flange 110 and the inner surface 60 of the neck finish 50. The adhesive 140 can extend from between the external flange 100 and the outer surface 70 to between the bridge 120 and the top surface 80 to between the internal flange 110 and the inner surface 60.

The top surface 80 can be embedded in the adhesive 140. That is, at particular locations around the longitudinal axis L or even all the way around the longitudinal axis L, the adhesive 140 can extend across the top surface 80 between the inner surface 60 and outer surface 70 and at least partially between the external flange 100 and neck finish 50 and at least partially between the internal flange 110 and the neck finish 50. Providing the adhesive 140 such that the entire top surface 80 is embedded in or in contact with the adhesive 140 can provide for a leak resistant seal between the neck finish 50 and the fitment 90. Further, providing adhesive 140 that extends from between the external flange 100 and the outer surface 70, across the top surface 80, to between the internal flange 110 and the inner surface 60, can provide for a leak resistant seal between the neck finish 50 and fitment 90 as well has for mechanical engagement between such parts and surfaces.

As shown in FIG. 3, the fitment 90 can comprise threads 170 on a surface of the fitment 90 oriented away from the longitudinal axis L. Such an arrangement is practical if the closure 180 screws onto the neck finish 50. The threads 170 can be positioned on a surface of the fitment 90 oriented away from the longitudinal axis L. Optionally, the threads 170 can be positioned on a surface of the fitment 90 oriented towards the longitudinal axis L. A closure 180 can be engaged with the fitment 90 by the threads 170. The closure 180 can be engaged with threads 170 that are the external flange 100 oriented away from the longitudinal axis L or threads 170 that are on the internal flange 110 oriented towards the longitudinal axis L.

Typically the container body 20 and fitment 90 are plastic parts that fit together tightly. To further enhance mechanical engagement between the container body 20 and the fitment 90 the two parts can be adhered together. The adhesive 140 can help to provide a liquid tight seal between the container body 20 and the fitment 90, particularly if the adhesive 140 forms a continuous seal between the container body 20 and the fitment 90. Optionally, if the adhesive 140 is discontinuous, the adhesive 140 may be provide for enhanced mechanical engagement between the container body 20 and the fitment 90.

The adhesive 140 can help to resist the fitment 90 moving away from the neck finish 50 when tension is applied to the fitment 90 in a direction away from the neck finish 50. The adhesive 140 can also help to resist the fitment 90 moving in torsion around the neck finish 50 around the longitudinal axis L if a torsional load is applied to the fitment 90. The adhesive 140 can also provide for a cushion between fitment 90 and neck finish 50 if the fitment 90 is subject to compression. The adhesive 140 can also provide for a leak resistant seal between the fitment 90 and the neck finish 50.

The adhesive 140 can be a hot melt adhesive. The adhesive 140 can be DURAPRO IFS brand XJF-6-101-4-UV or DURAPRO IFS brand XJF-6-142-4-UV, both available from Durapro, Reading, Pa., USA. The adhesive 140 can help to seal the fitment 90 to the neck finish 50. The adhesive 140 can also help to dampen energy transfer between the fitment 90 and the neck finish 50. For example, if the container 10 is dropped such that the fitment is rapidly loaded, as might occur if the container 10 is dropped so that the fitment 90 impacts a rigid surface or impacts the interior of a box in which the container 10 is shipped, the adhesive 140 can dampen the energy transfer from the fitment 90 to the container body 20.

The adhesive 140 can have a Tan Delta from about 0.65 to about 3. The adhesive 140 can have a Tan Delta from about 0.7 to about 3. The adhesive 140 can have a Tan Delta from about 0.75 to about 3. The adhesive 140 can have a Tan Delta from about 0.8 to about 3. The adhesive 140 can have a Tan Delta from about 0.85 to about 3. The adhesive 140 can have a Tan Delta from about 0.9 to about 3. The adhesive 140 can have a Tan Delta from about 0.95 to about 3.

The adhesive 140 can have a Tan Delta from about 1 to about 3. The adhesive 140 can have a Tan Delta from about 0.65 to about 2.5. The adhesive 140 can have a Tan Delta from about 0.7 to about 2.5. The adhesive 140 can have a Tan Delta from about 0.75 to about 2.5. The adhesive 140 can have a Tan Delta from about 0.8 to about 2.5. The adhesive 140 can have a Tan Delta from about 0.85 to about 2.5. The adhesive 140 can have a Tan Delta from about 0.9 to about 2.5.

The adhesive 140 can have a Tan Delta from about 0.95 to about 2.5. The adhesive 140 can have a Tan Delta from about 0.98 to about 2.33, or even 0.98 to 2.33. The adhesive 140 can have a Tan Delta from about 1 to about 2.5.

Delta is an expression of the phase shift between applied stress and the material response. Delta can theoretically range from 0 degrees for a perfectly elastic material to 90 degrees for a perfectly viscous material. Thus, low values of Tan Delta, which is the tangent of delta, are associated with more elastic materials and higher values of Tan Delta are associated with more viscous materials.

Adhesives that have too low of a Tan Delta tend to respond as an elastic material. Such adhesives tend not dampen impacts appreciably. Further such adhesives may be stiff and or brittle. Containers that have a fitment attached to the container body with an adhesive having a low value of Tan Delta will tend to leak and or possibly crack when shipped through direct to consumer channels. Without being bound by theory, it is thought that designers of containers having a fitment attached to the container body with an adhesive have tended to focus on using adhesives that tend to respond in a manner more towards the behavior of an elastic material.

Tan Delta of adhesive 140 is measured according to the Tan Delta Test Method disclosed herein.

Figure 4:
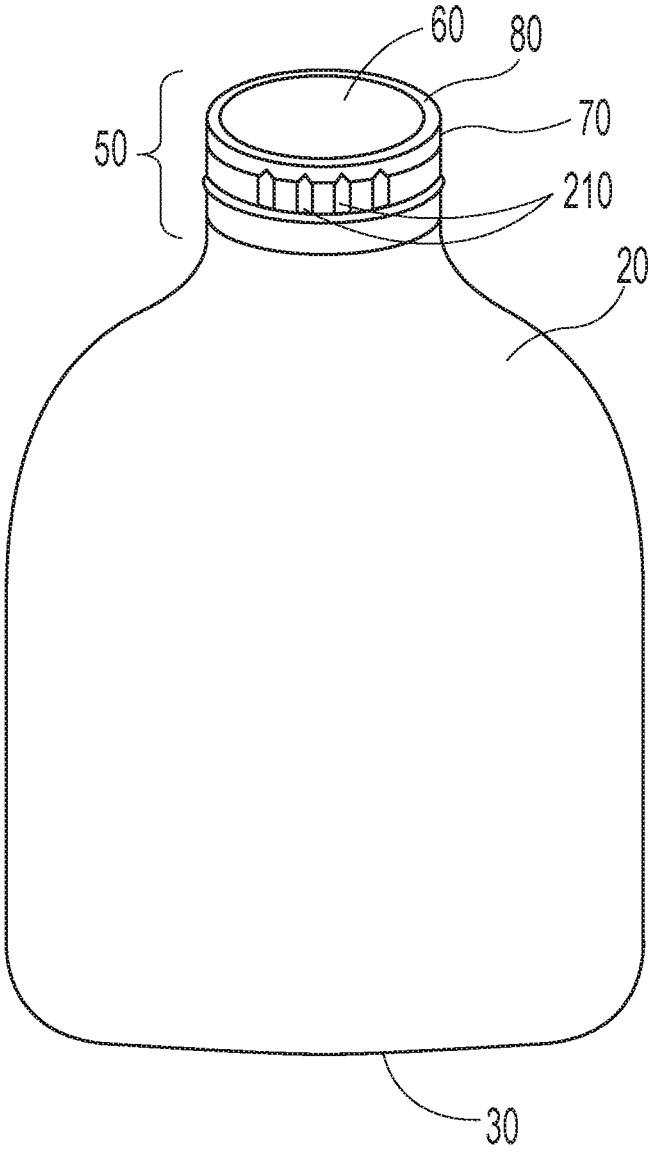
FIG. 4 is a container body having a neck finish.

The neck finish 50 can be provided with one or more neck teeth 210 that engage with one or more flange teeth, by way of a non-limiting example is shown in FIG. 4. The neck teeth 210 can be provided on the outer surface 70 of the neck finish 50. The neck teeth 210 can be oriented away from the longitudinal axis L.

Figure 5:
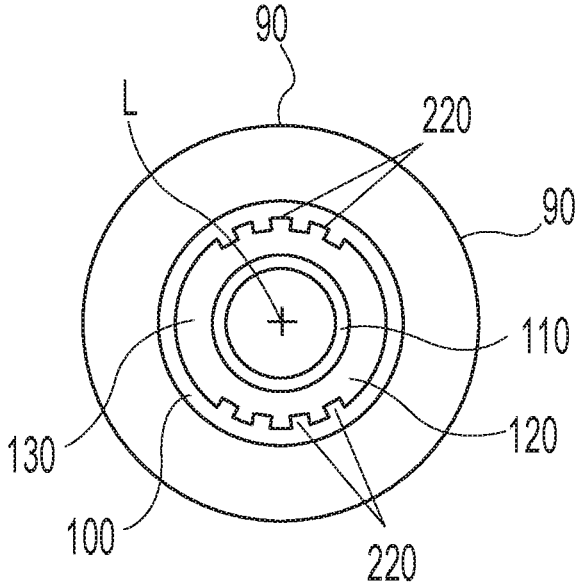
FIG. 5 is a bottom view of a fitment.

The external flange 100 can be provided with one or more flange teeth 220, by way of non-limiting example as shown in FIG. 5. FIG. 5 is a bottom view of a fitment 90. The neck teeth 210 and flange teeth 220 can be complementary to one another. The neck teeth 210 and flange teeth 220 can interlock with one another. Optionally, the neck teeth 210 and flange teeth 220 can tightly interlock with one another. Interlocking teeth can help to provide the connection between the fitment 90 and the neck finish 50 with resistance to torsional loads applied across the interface between these two element. A lug and notch complementary structure can be used in the same locations and for the same purposes as the teeth.

The interlocking teeth can provide a back stop on rotation of the fitment 90 about the neck finish 50. The adhesive 140 may be able to resist torsional loads with an acceptable amount of strain up to some limit. Beyond that strain, the adhesive 140 may fail or yield an excessive amount. The adhesive 140 may also provide for resistance to leakage between the neck finish 50 and the fitment 90 so long as the strain is not excessive. The tolerance of the fit between the neck teeth 210 and the flange teeth 220 can be set so that the teeth engage with one another before the torsional movement of the teeth relative to one another exceeds an amount such that the mechanical and or sealing integrity of the adhesive 140 is degraded. Optionally, the teeth can fit together tightly, that is have a low tolerance fit, so that little torsional movement of the fitment 90 relative to the neck finish 50 is permitted under anticipated torsional loads.

The interlocking teeth can be shaped to be more resistant to torsion applied in one rotational direction than the other. That might be practical if the fitment 90 is a part having threads to which a closure 180 having cooperating threads is rotationally secured thereto. The teeth may be sized and dimensioned to resist clockwise torsion about the longitudinal axis L as viewed from above the open end 40.

Figure 6:
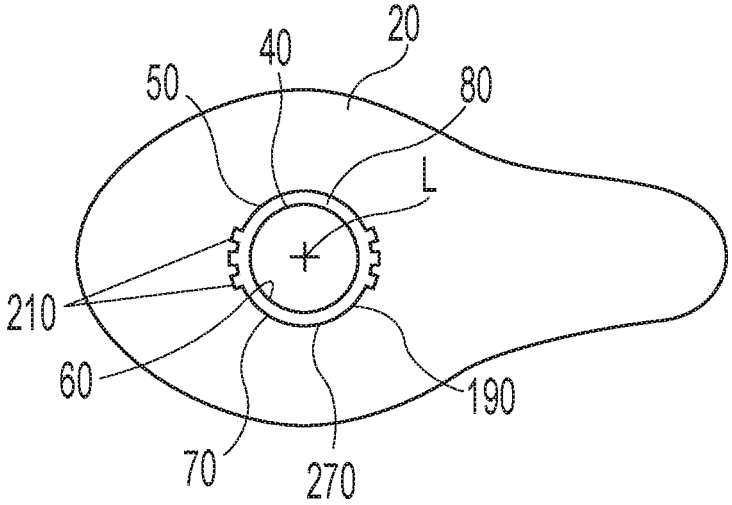
FIG. 6 is a top view of a container body.

A top view of the container body 20 is shown in FIG. 6. The neck finish 50 can present as an annulus in this view. The top surface 80 can have a peripheral length 190 around the longitudinal axis L. The peripheral length 190 is the length of the top surface measured along the top surface 80 where the top surface 80 meets the external surface 270. For a circular neck finish 50, the peripheral length is pi multiplied by the outside diameter of the open end 40. For thin walled container bodies 20, there is little difference between the length of the periphery of the top surface 80 as measured along the location where the top surface 80 meets the internal surface 60 and the peripheral length 190.

There can be from about 0.001 to about 0.1 mg of adhesive 140 per millimeter of the peripheral length 190. The mass of adhesive 140 per millimeter of the peripheral length 190 is the average mass of adhesive 140 per millimeter of the peripheral length 190. It is the measure of the total mass of adhesive 140 between the fitment 90 and the neck finish 50 divided by the peripheral length 190.

Figure 7:
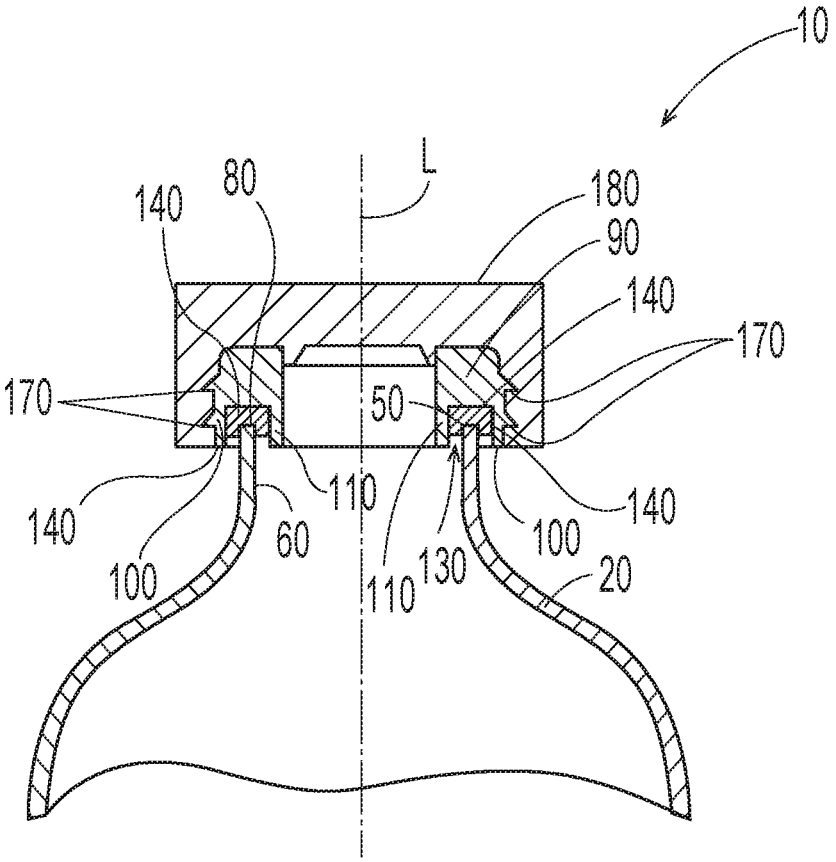
FIG. 7 is a cross section of a fitment to which a closure is attached, an upper part of the container body is shown.

The fitment 90 can comprise threads 170 on the external flange 100 oriented away from the longitudinal axis L, by way of non-limiting example as shown in FIG. 7. Such an arrangement can be practical for providing a closure 180 that covers or partially covers the fitment 90.

Figure 8:
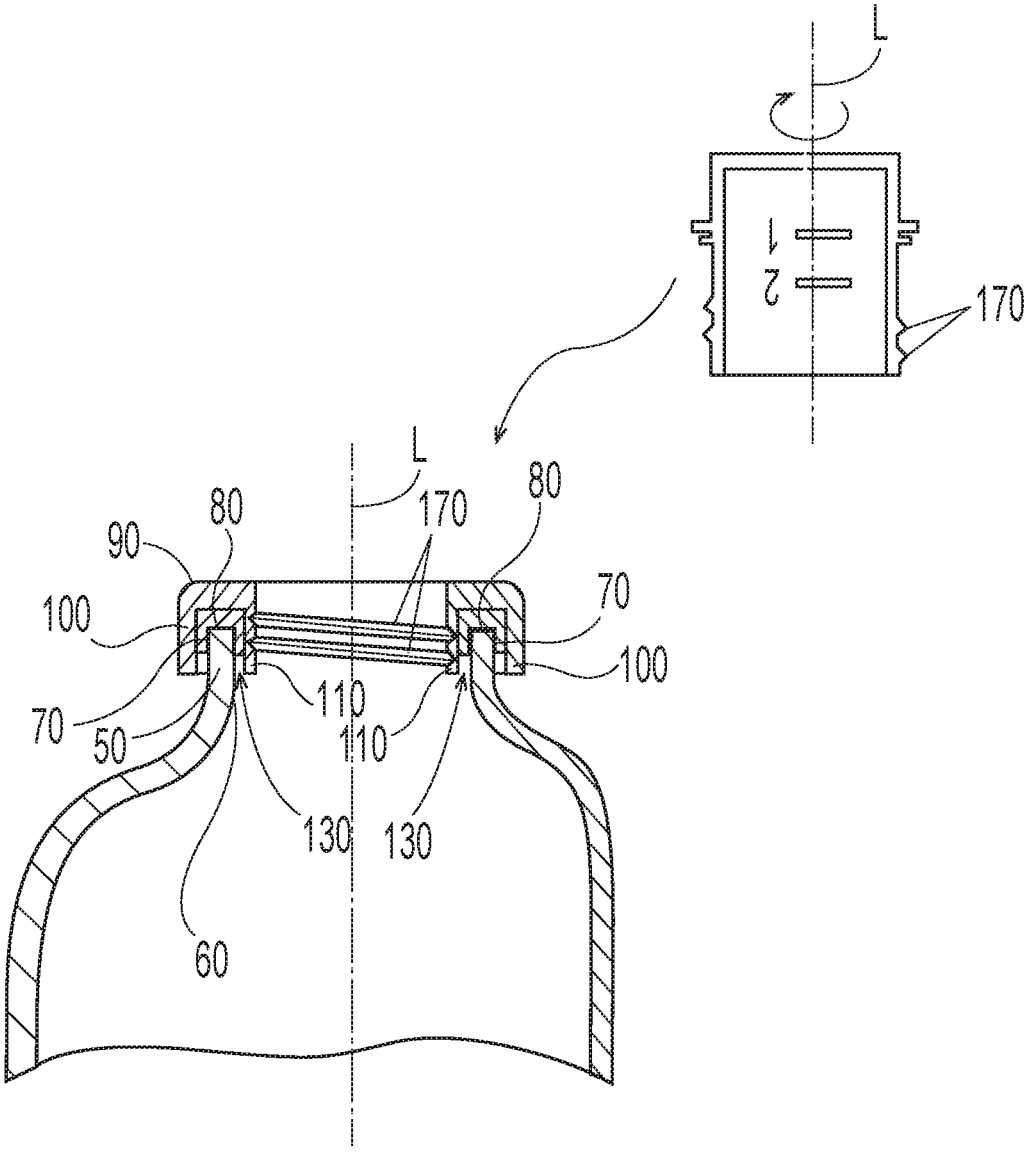
FIG. 8 is a cross section of a fitment attached to a neck finish and a closure positioned to be ready to attach to the fitment, an upper part of the container body is shown.

The fitment 90 can comprise threads 170 on the internal flange 110 oriented towards the longitudinal axis L, as shown in FIG. 8. The threads 170 on the internal flange 110 can be sized and dimensioned to receive corresponding threads 170 located on a surface of the closure 180 oriented away from the longitudinal axis L.

The closure 180 can be a flange seal closure 180. That is, there can be a peripheral flange 230 that flexes and fits tightly up against the fitment 90 to seal the container body 20 closed. In such an arrangement, the container 10 comprises the container body 20, the fitment 90 attached to the neck finish 50, the adhesive 140, the fitment 90, and the closure 180 screwed into the fitment 90.

Figure 9:
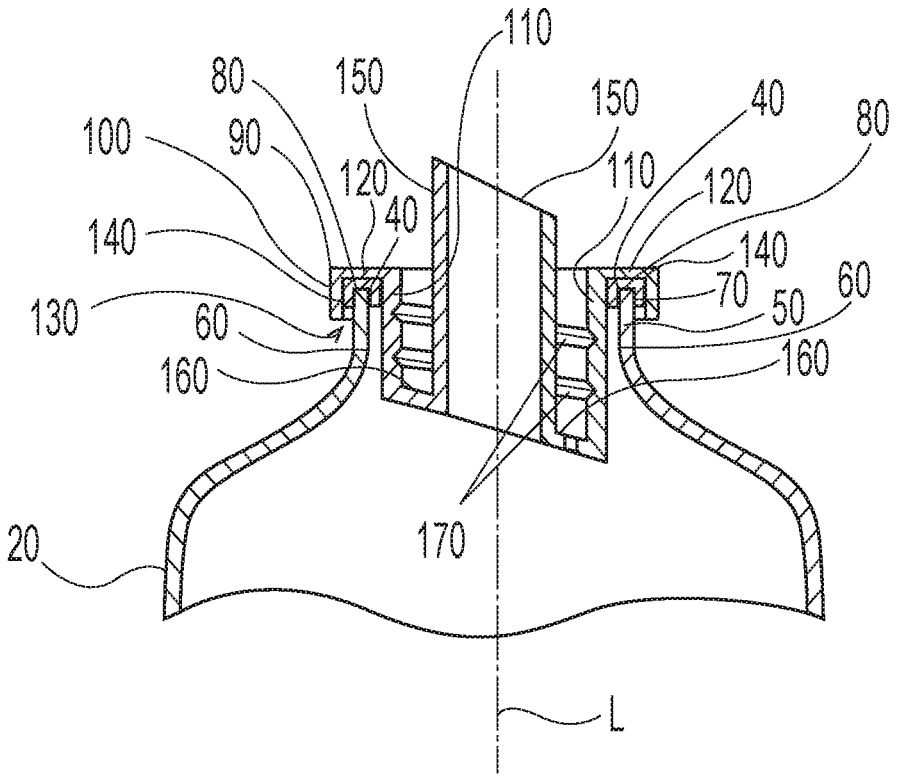
FIG. 9 is a cross section of a fitment that includes a spout.

The fitment 90 can further comprise a spout 150 engaged with the internal flange 110, wherein said spout extends upwardly away from the closed end 30, by way of non-limiting example as shown in FIG. 9. The spout 150 can be positioned around the longitudinal axis L. It can be practical to provide a fitment 90 that is a spout 150 to help the consumer precisely dispense liquid consumer product 15 from the container body 20.

The fitment 90 and closure 180 can be injection molded parts. The tolerances with which injection molded parts can be made can be exacting. The closure 180 can seal tightly to the fitment 90, for example by way of the threads pulling the closure 180 more tightly up against the fitment 90 as the closure 180 is rotated. Extrusion blow mold container bodies 20 are relatively simple and inexpensive to make. Gluing the fitment 90 to the neck finish 50 of an extrusion blow molded container body 20 can provide for a mechanically strong connection between the fitment 90 and the container body 20. And gluing the fitment 90 to the neck finish 50 can provide a leak resistant connection.

The fitment 90 can further comprise a floor 160 extending at least partially around the longitudinal axis L and connect the spout 150 to the internal flange 110. The floor 160 can be sloped back to a slot or hole through which liquid consumer product 15 that might drip from the tip 240 of the spout can be caught on the floor 160 and drain back into the container body 20.

Figure 10:
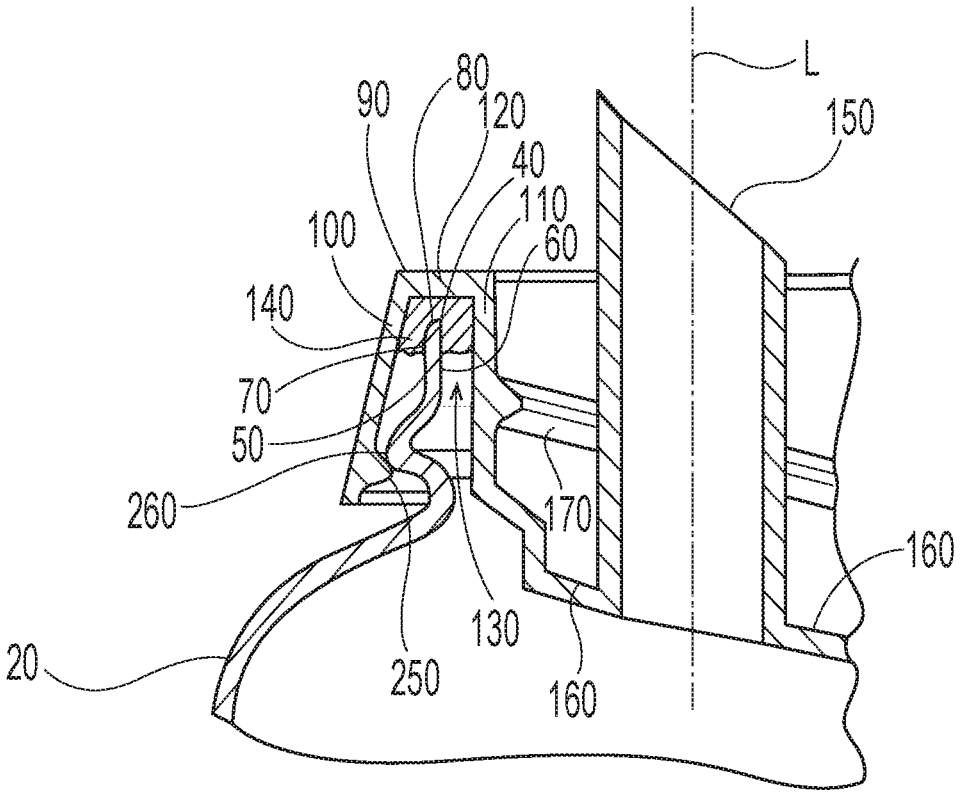
FIG. 10 is a cross section of a fitment that includes a spout, the fitment attached to a neck finish.

The fitment 90 and the neck finish 50 can each have geometry that cooperates with the other to provide for a snap together fit of the two components. A nonlimiting example of the fit of a fitment 90 and neck finish 50 is shown in FIG. 10. The outer surface 70 and the external flange 100 can be spaced apart from one another by from about 0.2 mm to about 5 mm, or even about 1 mm. The inner surface 60 and the internal flange 110 can be spaced apart from one another by from about 0.2 mm to about 5 mm, or even about 2 mm. The top surface 80 and the bridge 120 can be spaced apart from one another by from about 0.2 mm to about 5 mm, or even about 2 mm.

The fitment 90 can be provided with a catch 250 protruding from the external flange 100 towards the longitudinal axis L. The catch 250 can extend circumferentially or partially circumferentially about the longitudinal axis L. The catch 250 can positioned, sized, and dimensioned to fit with a rib 260 in the neck finish oriented away from the longitudinal axis L. The catch 250 can protrude from the external flange 100 by about 2 mm. The rib 260 can extend circumferentially or partially circumferentially about the longitudinal axis L. The rib 260 can project away from the upper part of the neck finish by about 2 mm. The catch 250 and rib 260 can function to provide resistance the fitment 90 and neck finish 50 from being pulled apart in the longitudinal direction and to hold the fitment 90 in the proper place as the adhesive 140 hardens.

The fit of the fitment 90 and neck finish 50 can be sized and dimensioned so that the slot 130 is spacious enough so that the adhesive 140 can be continuous from the space between the external flange 100 and outer surface 70 through the space between the bridge 120 and the top surface 80 to the space between the internal flange 110 and the inner surface 60. The adhesive 140 can act as a cushion to dampen the impact force of the container 10 being dropped which can reduce the potential for the fitment 90 or closure 180 attached to the fitment 90, if provided, to crack under impact. Further the adhesive 140 can provide a leak resistant seal between the fitment 90 and the neck finish 50.

Adhesive 140 can be applied in the slot 130 in a molten state. The adhesive 140 can be applied using a nozzle. The nozzle and fitment 90 can move relative to one another so that adhesive is provide around the entire or a portion of the slot 130. The nozzle can move around the fitment 90 or the fitment 90 can be rotated underneath a stationary nozzle. The adhesive 140 can be applied in a single pass or multiple passes. It can be practical to apply the adhesive 140 at a temperature from about 110 C to about 150 C, optionally from about 127 C to about 132 C.

Figure 11:
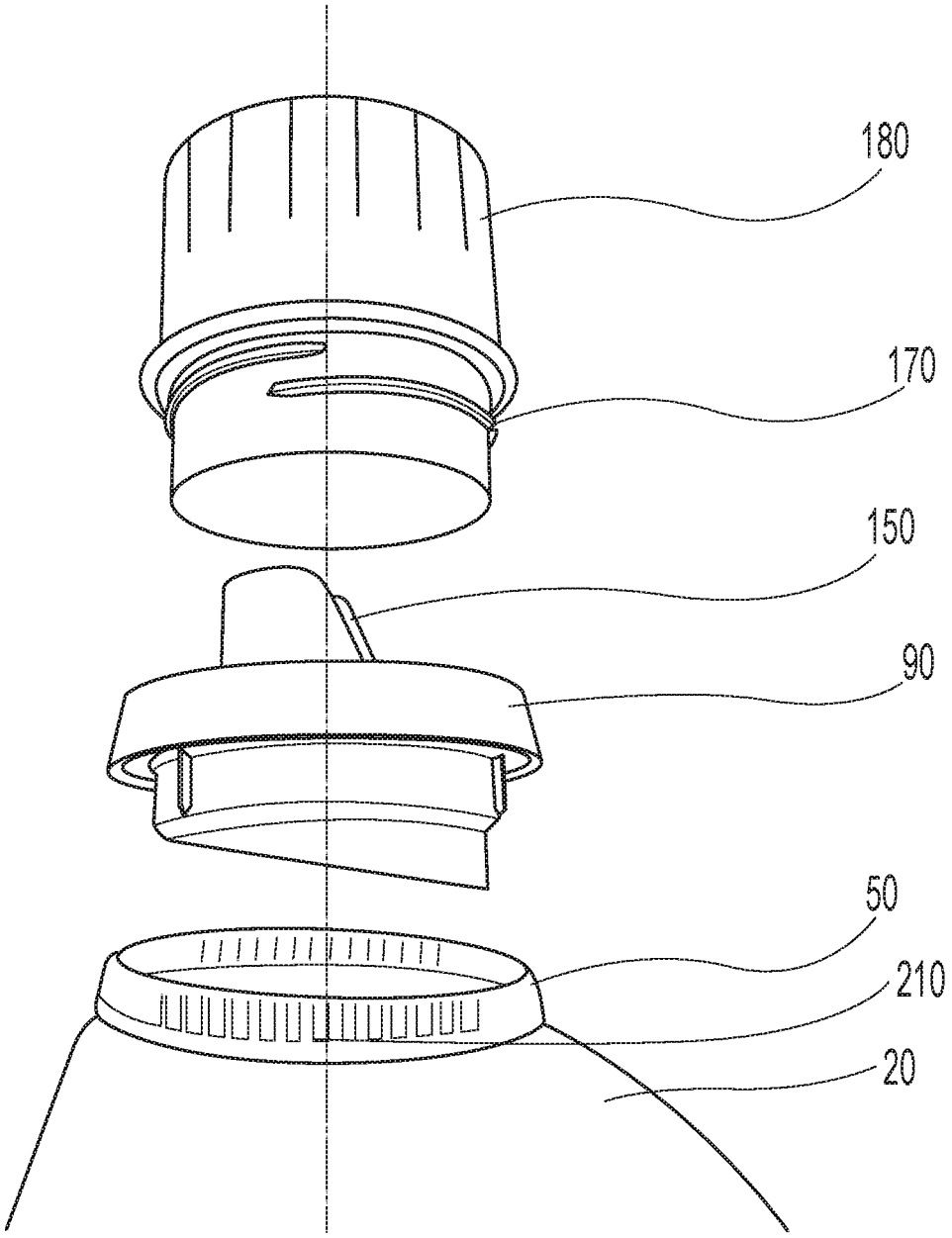
FIG. 11 is an image neck finish, a fitment including a spout, and a closure representative of the container tested following International Safe Transit Association (ISTA) Project 6-AMAZON.COM-Over Boxing, e-Commerce Fulfillment for Parcel Delivery Shipment, last technical change August, 2016, Sequence Number 3.

The container body 20, fitment 90, and closure 180 can be of the type in which TIDE liquid laundry detergent or DOWNY liquid fabric softener is sold by the The Procter & Gamble Company, Cincinnati, Ohio, United States of America, as of the filing date of this specification, an example of which is shown in FIG. 11.

Laboratory testing was performed to evaluate the performance of various adhesives 140 for gluing a fitment 90 to a neck finish 50. Testing was conducted following International Safe Transit Association (ISTA) Project 6-AMAZON-.COM-Over Boxing, e-Commerce Fulfillment for Parcel Delivery Shipment, last technical change August, 2016, Sequence Number 3. Test Project 6-Amazon.com-Over Boxing is a general simulation test for e-Commerce fulfillment. In comparison to items ready to ship in its own packaging (Test Project 6-Amazon.com-SIOC), this kind of e-Commerce fulfillment comprises an individual retail packaged-product weighing 70 pounds (32 kilograms) or less being placed into a master shipping container (Over Box) either by itself with the addition of dunnage (air pillows, etc.) or with multiple individual retail packaged-products with dunnage for shipment from Amazon.com to an end consumer through a parcel delivery system. This test challenges the packaging and/or products, whether primary package or transport package, ability to withstand the general damage-producing motions, forces, conditions, and sequences of this environment.

For each adhesive tested, a total of 10 containers were tested. Four of the tests were single item tests. Six of the tests were multiple item tests. The single item test is intended to represent shipment of a single container in a box. The multiple item test is intended to represent shipment of a single container and 2 additional articles within a box.

The container design tested in the tests was the 2.94 L TIDE liquid detergent having the container design used in the United States as of the filing date of this specification. Approximately 2 g of the adhesive tested was placed in the slot of the fitment. The container was closed with a closure screwed into the fitment. The fitment included a spout. An image of the neck finish, the fitment, and closure representative of the design of the container tested is shown in FIG. 11.

For the single item test, the over box was a 35.56 cm by 20.32 cm by 20.32 cm ULINE S-4139 box. The box was filled with a 2.94 L bottle of TIDE liquid detergent available from The Procter & Gamble Company, Cincinnati, Ohio, USA, and ULINE inflatable cellular air pillow cushioning S-12881 available from ULINE, Pleasant Prairie, Wis., USA. The bottle was placed in the over box with the closure contacting face 4 and face 6 following the ISTA procedures. The air pillows were loosely packed in the box and the box was taped closed. Four single item samples were tested.

For the multiple item test, the over box was 45.72 cm by 22.86 cm by 22.86 cm ULINE S4632 box. The box was filled with a 2.94 L bottle of TIDE liquid detergent. An F-sized hazard 102 mm by 102 mm by 102 mm having a mass of 1.36 kg and a G-sized hazard 102 mm by 76 mm by 51 mm having a mass of 1.59 kg were included in the box. ULINE inflatable cellular air pillow cushioning S-12881 were loosely packed in the box and the box and the box was taped closed. Six multiple item samples were tested.

Results of the testing are listed in Table 1.

TABLE 1

International Safe Transit Association (ISTA) Project 6-AMAZON.COM-Over Boxing, e-Commerce Fulfillment for Parcel Delivery Shipment Test Results.

| Adhesive | TanDelta | Shattered Spout Fitment | Leak between Spout Fitment and Neck Finish | Comment |
|---|---|---|---|---|
| IFS 101-4 from Durapro, Reading, Pennsylvania, USA | 2.33 | 0 out of 10 | 1 out of 10 | Small leak detected with water and soap solution deemed not to be consumer objectionable |
| IFS 142-4 from Durapro, Reading, Pennsylvania, USA | 1.17 | 0 out of 10 | 1 out of 10 | Slow leak deemed not to be consumer objectionable |
| Valco Melton 8056 from Valco Melton, Cincinnati, Ohio, USA | 0.98 | 0 out of 10 | 1 out of 10 | Slow leak deemed not to be consumer objectionable |
| ASI 4055M from Adhesives Specialists Incorporated, Allentown, Pennsylvania, USA (used in the container for TIDE liquid laundry detergent in the United States as of the filing date of this specification) | 0.56 | 1 out of 10 | 2 out of 10 | Transition shattered, transition leaks severe, consumer objectionable |

For the containers tested, two of the ten containers that employed an adhesive having a Tan Delta of 0.56 severely leaked and the spout fitment of one container shattered. For the containers having the other adhesives tested, none of the spout fitments shattered. Only one of the ten containers tested for each of the other adhesives tested leaked. The single leak that occurred out of the ten containers tested that employed Valco Melton 8056 was determined to be a slow leak, i.e. a small quantity of liquid over the duration of the testing, and deemed not to be consumer objectionable. The single leak that occurred out of the ten containers tested that employed IFS 142-4 was determined to be a slow leak, i.e. a small quantity of liquid over the duration of the testing, and deemed not to be consumer objectionable.

Tan Delta Test Method

The Tan Delta test method is a dynamic mechanical analysis (DMA) used to determine a rheological parameter termed "Tan Delta" (tan δ), which may also be known as the tangent of delta, the loss tangent, the loss factor, the damping factor, or the tangent of the phase angle. The Tan Delta value is a parameter that characterizes the viscoelastic nature of a material, including materials such as a glue or a thermoplastic which may be used for gluing a fitment to a container body. In the Tan Delta test method, a test sample of material is cyclically compressed and the time lag/phase shift in stress development is measured relative to the strain applied. This permits the determination of the Storage Modulus (E'), and the Loss Modulus (E"), and hence the calculation of Tan Delta (tan δ=E"/E').

Dynamic stress-strain testing measurements for the determination of Tan Delta are made with a DMA Analyzer such as the model RSA-G2 Solids Analyzer (available from TA Instruments, New Castle, Del., U.S.A.) or equivalent, and the manufacturer's accompanying software. The DMA instrument is configured with 25.4 mm diameter parallel compression plates and a temperature-controlling environmental chamber which surrounds the sample. The DMA instrument is configured to collect data during cyclical compression testing with mode settings of strain-controlled, fixed-frequency, and axial-application. The instrument is calibrated in accordance with the manufacturer's recommendations.

A test sample of glue material may be obtained from an emptied and thoroughly cleaned assembled container by physically cutting the container to separate the bulk of the container material away from the relevant glue-containing portion (e.g., the closure or transition piece). The glue containing portion is then placed in an oven set to a temperature that is above the melting point of the glue (e.g. 93° C. may be a suitable temperature for some glues). A suitable temperature can be determined empirically by observing and comparing the softness of the glue at various temperatures. Once the glue has softened due to the heat of the oven, the glue is removed from the packaging by scraping with a small spatula. In order to obtain a sufficient amount of test sample for analysis, several assembled package containers may need to be processed in this manner and the harvested glue pooled together.

To prepare the test sample for testing, the glue to be tested is warmed sufficiently to enable the test sample to be formed into a sample disc shape having dimensions of 25.4 mm in diameter and 2 mm in thickness. A 25.4 mm diameter casting mold or die cutter ring may be helpful to achieve the correct dimensions for the sample disc. It is important that bubbles are excluded from the sample disc during its preparation.

The Environmental Control is set with a Temperature of 23° C.; Equilibrium is set with a Perform Equilibration selected as On; and Equilibrium Duration is set to 600 s. Wait for Temperature is selected as On; Mode is set to Standard CyclicCompression Strain; CompressionRate Frequency is set to 100 Hz; Strain is set to 0.02% of the gap distance; Duration is set to 10,000 repetitions; the preload force is set at 5 N; Inherit Set Point is selected as Off; Soak Time is set to 0.0 s. The DMA plates are cleaned with isopropanol and the solvent is allowed to evaporate away. The sample disc is loaded onto the center surface of the 25.4 mm diameter plate. The temperature is monitored to ensure that the environmental sample chamber reaches the set temperature of 23° C. The sample disc is equilibrated to 23° C. prior to the start of data collection. The plate is lowered to a preload force set at 5 N. The gap distance is recorded. It is important to ensure that the sample disc is evenly distributed around the edge of the plates.

The instrument-accompanying software is used to calculate the median Tan Delta (tan δ), Storage Modulus (E'), Loss Modulus (E") values, using all the data points collected throughout the entire cyclic compression test, where the software's calculations are conducted in accordance with the following equations and definitions:

$$\text{Tan Delta}(\tan\delta)=E''/E'$$

wherein:

$E'=\cos\delta(\sigma/\varepsilon)$ $E''=\sin\delta(\sigma/\varepsilon)$ and wherein:

δ=phase angle (in units of degrees)

σ=stress (in units of Pa)

ε=strain (in units of %)

Three independent replicate sample discs are prepared and analyzed for a given material, where each sample disc provides a median Tan Delta value. The Tan Delta value reported for the material is the average of the three median values measured from the three replicate sample discs. The resultant average Tan Delta value reported is a unitless expression.

Combinations:

An example is below:

A. A container (10) comprising:

a container body (20) having a closed end (30) and an opposing open end (40), wherein said open end comprises a neck finish (50) having a longitudinal axis (L) passing through said open end, an inner surface (60) oriented towards said longitudinal axis, an outer surface (70) oriented away from said longitudinal axis, and a top surface (80) extending between said inner surface and said outer surface;

a fitment (90) fitted at least partially within said neck finish, said fitment comprising an external flange (100) exterior to said neck finish and downwardly depending towards said closed end, an internal flange (110) interior to said neck finish and downwardly depending towards said closed end, and a bridge (120) extending across said top surface from said external flange to said internal flange, wherein said external flange, said bridge, and said internal flange together form a slot (130) extending at least partially around said longitudinal axis; and an adhesive (140) positioned within said slot between said neck finish and said fitment, wherein said adhesive has a Tan Delta from 0.65 to 3.

B. The container according to Paragraph A, wherein said top surface is embedded in said adhesive.

C. The container according to Paragraph A or B, wherein said fitment further comprises a spout (150) engaged with said internal flange, wherein said spout extends upwardly away from said closed end.

D. The container according to any of Paragraphs A to C, wherein said fitment further comprises a floor (160) extending at least partially around said longitudinal axis connecting said spout to said internal flange.

E. The container according to any of Paragraphs A to D, wherein said fitment further comprises threads (170) on said external flange oriented away from said longitudinal axis or on said internal flange oriented towards said longitudinal axis.

F. The container according to Paragraph E, wherein said container further comprises a closure (180) engaged with said threads.

G. The container according to Paragraph E or F, wherein said threads are on said internal flange oriented towards said longitudinal axis.

H. The container according to Paragraph A, wherein said fitment is a closure (180).

I. The container according to Paragraph H, wherein said closure is a flip top closure (200).

J. The container according to any of Paragraphs A to I, wherein said outer surface comprises one or more neck teeth (210) oriented away from said longitudinal axis and said external flange comprises one or more flange teeth (220) oriented towards said long longitudinal axis, wherein said neck teeth and said flange teeth are engaged with one another.

K. The container according to any of Paragraphs A to J, wherein said top surface has a peripheral length (190) around said longitudinal axis and there is from about 0.001 to about 0.1 mg of said adhesive per millimeter of said peripheral length.

L. The container according to any of Paragraphs A to K, wherein said adhesive extends from between said external flange and said outer surface to between said bridge and said top surface to between said internal flange and said inner surface.

M. The container according to any of Paragraphs A to L, wherein said container body contains from 1 to 5 L of liquid laundry treatment composition having a density of from 0.7 to 1.2 g/cm$^3$.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A container (10) comprising:

a container body (20) having a closed end (30) and an opposing open end (40), wherein said open end comprises a neck finish (50) having a longitudinal axis (L)

passing through said open end, an inner surface (60) oriented towards said longitudinal axis, an outer surface (70) oriented away from said longitudinal axis, and a top surface (80) extending between said inner surface and said outer surface;

a fitment (90) fitted at least partially within said neck finish, said fitment comprising an external flange (100) exterior to said neck finish and downwardly depending towards said closed end, an internal flange (110) interior to said neck finish and downwardly depending towards said closed end, and a bridge (120) extending across said top surface from said external flange to said internal flange, wherein said external flange, said bridge, and said internal flange together form a slot (130) extending at least partially around said longitudinal axis; and an adhesive (140) positioned within said slot between said neck finish and said fitment;

wherein said adhesive has a Tan Delta from about 0.65 to about 3; and wherein said top surface is embedded in said adhesive.

2. The container according to claim 1, wherein said fitment further comprises a spout (150) engaged with said internal flange, wherein said spout extends upwardly away from said closed end.

3. The container according to claim 2, wherein said fitment further comprises a floor (160) extending at least partially around said longitudinal axis connecting said spout to said internal flange.

4. The container according to claim 3, wherein said fitment further comprises threads (170) on said external flange oriented away from said longitudinal axis or on said internal flange oriented towards said longitudinal axis.

5. The container according to claim 4, wherein said container further comprises a closure (180) engaged with said threads.

6. The container according to claim 5, wherein said threads are on said internal flange oriented towards said longitudinal axis.

7. The container according to claim 5, wherein said top surface has a peripheral length (190) around said longitudinal axis and there is from about 0.001 to about 0.1 mg of said adhesive per millimeter of said peripheral length.

8. The container according to claim 1, wherein said fitment is a closure (180).

9. The container according to claim 8, wherein said closure is a flip top closure (200).

10. The container according to claim 1, wherein said outer surface comprises one or more neck teeth (210) oriented away from said longitudinal axis and said external flange comprises one or more flange teeth (220) oriented towards said long longitudinal axis, wherein said neck teeth and said flange teeth are engaged with one another.

11. The container according to claim 10, wherein said top surface has a peripheral length (190) around said longitudinal axis and there is from about 0.001 to about 0.1 mg of said adhesive per millimeter of said peripheral length.

12. The container according to claim 11, wherein said adhesive extends from between said external flange and said outer surface to between said bridge and said top surface to between said internal flange and said inner surface.

13. The container according to claim 12, wherein said fitment further comprises a spout (150) engaged with said internal flange, wherein said spout extends upwardly away from said closed end.

14. The container according to claim 13, wherein said fitment further comprises a floor (160) extending at least partially around said longitudinal axis connecting said spout to said internal flange.

15. The container according to claim 14, wherein said fitment further comprises threads (170) on said external flange oriented away from said longitudinal axis or on said internal flange oriented towards said longitudinal axis.

16. The container according to claim 15, wherein said container further comprises a closure (180) engaged with said threads.

17. The container according to claim 16, wherein said threads are on said internal flange oriented towards said longitudinal axis.

18. A container (10) comprising:

a container body (20) having a closed end (30) and an opposing open end (40), wherein said open end comprises a neck finish (50) having a longitudinal axis (L) passing through said open end, an inner surface (60) oriented towards said longitudinal axis, an outer surface (70) oriented away from said longitudinal axis, and a top surface (80) extending between said inner surface and said outer surface;

a fitment (90) fitted at least partially within said neck finish, said fitment comprising an external flange (100) exterior to said neck finish and downwardly depending towards said closed end, an internal flange (110) interior to said neck finish and downwardly depending towards said closed end, and a bridge (120) extending across said top surface from said external flange to said internal flange, wherein said external flange, said bridge, and said internal flange together form a slot (130) extending at least partially around said longitudinal axis; and an adhesive (140) positioned within said slot between said neck finish and said fitment, wherein said adhesive has a Tan Delta from about 0.7 to about 3;

wherein said top surface is embedded in said adhesive;

wherein said fitment further comprises a spout (150) engaged with said internal flange, wherein said spout extends upwardly away from said closed end;

wherein said top surface has a peripheral length (190) around said longitudinal axis and there is from about 0.001 to about 0.1 mg of said adhesive per millimeter of said peripheral length; and wherein said container body contains from about 1 to about 5 L of a liquid fabric treatment composition having a density of from about 0.7 to about 1.2 g/cm$^3$.

19. The container according to claim 18, wherein said fitment further comprises threads (170) on said internal flange oriented towards said longitudinal axis and a closure (180) is engaged with said fitment by said threads.

* * * * *